US012742284B2

(12) United States Patent
Li et al.

(10) Patent No.: US 12,742,284 B2
(45) Date of Patent: Sep. 22, 2026

(54) ANTIMICROBIAL POLYMER COATINGS ON TEXTILES

(71) Applicant: MICROBAN PRODUCTS COMPANY, Huntersville, NC (US)

(72) Inventors: Yihong Li, Huntersville, NC (US); Ivan Wei Kang Ong, Charlotte, NC (US); Xiuzhu Fei, Charlotte, NC (US)

(73) Assignee: MICROBAN PRODUCTS COMPANY, Huntersville, NC (US)

( * ) Notice: Subject to any disclaimer, the term of this patent is extended or adjusted under 35 U.S.C. 154(b) by 680 days.

(21) Appl. No.: 18/200,164

(22) Filed: May 22, 2023

(65) Prior Publication Data

US 2023/0374727 A1 Nov. 23, 2023

Related U.S. Application Data

(60) Provisional application No. 63/344,190, filed on May 20, 2022.

(51) Int. Cl.

| | |
|---|---|
| ***D06M 13/00*** | (2006.01) |
| ***D06M 13/355*** | (2006.01) |
| ***D06M 15/263*** | (2006.01) |
| ***D06M 15/564*** | (2006.01) |

(52) U.S. Cl.

CPC ..... *D06M 13/355* (2013.01); *D06M 15/263* (2013.01); *D06M 15/564* (2013.01); *D10B 2401/13* (2013.01)

(58) Field of Classification Search

CPC ..... D06M 13/355; D06M 15/263; D06M 15/564; D06M 16/00; D10B 2401/13

USPC ..... 8/115.6

See application file for complete search history.

(56) References Cited

U.S. PATENT DOCUMENTS

| | | | | |
|---|---|---|---|---|
| 5,716,628 | A | 2/1998 | Vinopal et al. | |
| 5,854,266 | A | 12/1998 | Nelson, Jr. | |
| 10,081,781 | B2 | 9/2018 | Foster et al. | |
| 2005/0033251 | A1 | 2/2005 | Toreki et al. | |
| 2005/0182140 | A1* | 8/2005 | Payne | A61K 31/14 514/731 |
| 2008/0182125 | A1* | 7/2008 | Krishnan | E04C 2/043 428/688 |
| 2008/0287426 | A1 | 11/2008 | Waterhouse et al. | |
| 2010/0173121 | A1* | 7/2010 | Mull | D06M 15/576 428/96 |
| 2013/0045961 | A1 | 2/2013 | Smith, III et al. | |
| 2014/0326864 | A1 | 11/2014 | Foyle | |
| 2018/0370856 | A1* | 12/2018 | Nelson | C04B 28/24 |
| 2021/0025110 | A1 | 1/2021 | Swamy et al. | |
| 2021/0156080 | A1* | 5/2021 | Lau | D06M 15/59 |

FOREIGN PATENT DOCUMENTS

| | | | | |
|---|---|---|---|---|
| BR | 112019025219 B1 * | 9/2023 | | C04B 55/00 |
| WO | WO 2005014256 A1 * | 2/2005 | | C04B 26/18 |
| WO | 2013050086 A1 | 4/2013 | | |

OTHER PUBLICATIONS

International Preliminary Report on Patentability (IPRP) for corresponding International Patent Application No. PCT/US2023/023077; mailed on Dec. 5, 2024; (10 pages).

International Search Report and Written Opinion For PCT Application No. PCT/US23/23077 provided herein per MPEP 609.04(a)II Issued Sep. 29, 2023 (14 Pages).

* cited by examiner

*Primary Examiner* — Eisa B Elhilo

(74) *Attorney, Agent, or Firm* — Shumaker, Loop & Kendrick, LLP

(57) ABSTRACT

A composition having sodium pyrithione and a binder is provided. The composition may also have a softener. A method of using the composition is provided. The method includes applying a composition to a textile. A method of treating the textile with the composition to impart an antimicrobial and/or antifungal efficacy and durability is also provided.

23 Claims, No Drawings

ANTIMICROBIAL POLYMER COATINGS ON TEXTILES

CROSS-REFERENCE TO RELATED APPLICATIONS

This application claims priority from U.S. Provisional Patent Application No. 63/344,190, filed on May 20, 2022, in the United States Patent and Trademark Office. The disclosure of which is incorporated herein by reference in its entirety.

FIELD

The present invention relates to a composition and method for treatment of a textile, more particularly to a composition and method for imparting antimicrobial efficacy and antifungal efficacy.

BACKGROUND OF THE INVENTION

Current microbial, and fungal, control on textile garments relies heavily on the use of metal containing actives, such as zinc. The presence of "heavy metal" can cause many issues during processing in textile mills and are a growing cause for environmental concern.

Alternatively, the use of organic molecules, such as quaternary ammonium silanes, phenolics, and azoles, can be leveraged to treat textile surfaces. However, these compounds require extensive formulary efforts to reduce hydrophobicity and to increase durability on textile material.

Traditional chemistries used for wash-durable treatment of textiles are typically insoluble chemical species. Examples include triclosan, silver chloride, zinc pyrithione, and chitosan.

Therefore, the above methods are undesirable and the present invention addresses and overcomes the problems with these methods.

BRIEF SUMMARY

The present invention provides a solution for antifungal and antimicrobial efficacy on a textile while meeting evolving requirements of heavy metal-free compositions.

In an aspect of the invention, an antimicrobial composition is provided, the antimicrobial composition comprising: from 6 weight percent to 16 weight percent sodium pyrithione, from 10 weight percent to 25 weight percent of binder, and a balance of water.

In some aspects, the antimicrobial composition comprises from 8 weight percent to 13 weight percent sodium pyrithione. In some aspects, the antimicrobial composition comprises from 10 weight percent to 12 weight percent sodium pyrithione.

In some aspects, the antimicrobial composition comprises from 12 weight percent to 22 weight percent binder. In some aspects, the antimicrobial composition comprises from 16 weight percent to 19 weight percent binder.

In some aspects, the antimicrobial composition further comprises from 10 weight percent to 30 weight percent of a softener. In some aspects, the antimicrobial composition further comprises from 13 weight percent to 25 weight percent of a softener. In some aspects, the antimicrobial composition further comprises from 15 weight percent to 20 weight percent of a softener.

In some aspects, the softener is selected from the group consisting of sulphated fatty alcohol, anionic fatty acid polysiloxane, nonionic fatty acid polysiloxane, ethoxylated polysiloxane, polyethylene based softener, and a combination thereof.

In some aspects, the binder is selected from the group consisting of a polyacrylic binder, a polyurethane binder, and a combination thereof.

In some aspects, the composition is heavy metal-free.

In another aspect of the invention, a method of treating a textile is disclosed. The method comprising applying a composition to the textile thereby imparting antimicrobial efficacy to the textile; the composition comprising from 6 weight percent to 16 weight percent sodium pyrithione, from 10 weight percent to 25 weight percent of binder, and a balance of water. In some aspects, the composition is heavy metal-free.

In some aspects, the composition comprises from 8 weight percent to 13 weight percent sodium pyrithione. In some aspects, the composition comprises from 10 weight percent to 12 weight percent sodium pyrithione.

In some aspects, the composition comprises from 12 weight percent to 22 weight percent binder. In some aspects, the composition comprises from 16 weight percent to 19 weight percent binder.

In some aspects, the binder is selected from the group consisting of a polyacrylic binder, a polyurethane binder, and a combination thereof.

In some aspects, the antimicrobial composition further comprises from 10 weight percent to 30 weight percent of a softener. In some aspects, the antimicrobial composition further comprises from 13 weight percent to 25 weight percent of a softener. In some aspects, the antimicrobial composition further comprises from 15 weight percent to 20 weight percent of a softener.

In some aspects, the softener is selected from the group consisting of sulphated fatty alcohol, anionic fatty acid polysiloxane, nonionic fatty acid polysiloxane, ethoxylated polysiloxane, polyethylene based softener, and a combination thereof.

In some aspects, the textile is a fabric.

In some aspects, the composition is applied by a method selected from the group consisting of padding, spraying, roller coating, exhaustion, and a combination thereof.

In some aspects, the composition is applied to the textile by padding, in a padding bath. In some aspects, the padding bath has a pH from 4 to 8.5. In some aspects, after padding, the textile is cured at a temperature from 130° C. to 180° C. In some aspects, after padding, the textile is cured for a minimum of 45 seconds.

In some aspects, the composition is added along with a dye at the dying stage of exhaustion. In some aspects, the composition is added at a temperature form 60° C. to 130° C. In some aspects, the composition is exhausted for a time period of 20 minutes to one hour.

In another aspect of the present invention, an article is disclosed. The article comprising a textile material treated with a composition comprising sodium pyrithione at an effective amount to reduce fungal growth on the textile, and a binder at an effective amount to coat the textile. In some aspects, the composition is heavy metal-free.

In some aspects, the composition comprises from 6 weight percent to 16 weight percent sodium pyrithione. In some aspects, the composition comprises from 8 weight percent to 13 weight percent sodium pyrithione. In some aspects, the composition comprises from 10 weight percent to 12 weight percent sodium pyrithione.

In some aspects, the antimicrobial composition comprises from 10 weight percent to 25 weight percent binder. In some aspects, the antimicrobial composition comprises from 12 weight percent to 22 weight percent binder. In some aspects, the antimicrobial composition comprises from 16 weight percent to 19 weight percent binder.

In some aspects, the binder is selected from the group consisting of a polyacrylic binder, a polyurethane binder, and a combination thereof.

In some aspects, the antimicrobial composition further comprises from 10 weight percent to 30 weight percent of a softener. In some aspects, the antimicrobial composition further comprises from 13 weight percent to 25 weight percent of a softener. In some aspects, the antimicrobial composition further comprises from 15 weight percent to 20 weight percent of a softener.

In some aspects, the softener is selected from the group consisting of sulphated fatty alcohol, anionic fatty acid polysiloxane, nonionic fatty acid polysiloxane, ethoxylated polysiloxane, polyethylene based softener, and a combination thereof.

In some aspects, water is the balance of the total weight of the composition.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

DETAILED DESCRIPTION OF EMBODIMENTS OF THE INVENTION

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in," "at," and/or "on," unless the context clearly indicates otherwise. The phrase "in one embodiment," as used herein does not necessarily refer to the same embodiment, although it may.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within the ranges as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc. as well as 1, 2, 3, 4, and 5, individually. The same principle applies to ranges reciting only one numerical value as a minimum or a maximum. Furthermore, such an interpretation should apply regardless of the breadth of the range or the characteristics being described.

The present invention is related to an antimicrobial composition and method for treating a textile material for imparting antimicrobial properties. The composition disclosed herein provides a textile material with superior antimicrobial properties without the use of heavy metals. The term "heavy metal", as used herein, refers to any metal heavier than magnesium (atomic weight of 24.3 grams/mole).

In an aspect of the invention, an antimicrobial composition is provided comprising sodium pyrithione and a binder. The antimicrobial composition is heavy metal-free (meaning without heavy metal). Sodium pyrithione is a particle-free, heavy metal-free water-soluble compound. The binder is a polymer binder. The binder is preferably selected from the group consisting of a polyacrylic binder, a polyurethane binder, and a combination thereof. In an aspect of the invention, a composition is provided comprising sodium pyrithione, a binder, and a softener.

The antimicrobial composition may comprise sodium pyrithione and binder in a ratio from 1:1 to 1:5, 1:2 to 1:3, 1:2 to 1:5, 1:3 to 1:5, 1:1 to 1:4, 1:1 to 1:3, 1:1.5 to 1:3, or 1:25 to 1:35.

The antimicrobial composition may comprise from: 6 weight percent to 16 weight percent of sodium pyrithione. Preferably, the antimicrobial composition comprises from 8 weight percent to 13 weight percent sodium pyrithione. More preferably, the antimicrobial composition comprises from 10 weight percent to 12 weight percent sodium pyrithione.

The antimicrobial composition may comprise from 10 weight percent to 25 weight percent of binder. Preferably, the antimicrobial composition comprises from 12 weight percent to 22 weight percent of binder. More preferably, the antimicrobial composition comprises from 16 weight percent to 19 weight percent of binder.

The antimicrobial composition may comprise from 10 weight percent to 30 weight percent of softener. Preferably, the antimicrobial composition comprises from 13 weight percent to 25 weight percent. More preferably, the antimicrobial composition comprises from 15 weight percent to 20 weight percent.

The softener is preferably selected from the group consisting of a sulphated fatty alcohol, anionic fatty acid polysiloxane, nonionic fatty acid polysiloxane, ethoxylated polysiloxane, polyethylene based softener, and a combination thereof.

Other non-limiting examples of additives that can be incorporated in the composition of the present invention include, but are not limited to, surfactants, dispersants, pH adjusting agents, wicking aids, and a combination thereof.

The compositions are suitable for use for treating a textile thereby imparting antimicrobial properties and antifungal efficacy on a textile. The compositions also improve the fabric properties such as colorfastness and hand.

There is a synergistic effect with the combination of the sodium pyrithione and the binder which is even greater with the further addition of a softener.

In an aspect of the present invention, a method of using a composition is provided. The method comprises applying the composition to a textile, wherein the composition comprises sodium pyrithione and a binder, thereby imparting to the textile a property selected from the group consisting of antimicrobial efficacy, antifungal efficacy, and a combination thereof. The composition may further comprise a softener.

The composition may be applied to a textile material or fabric by any conventional or other technique known to one of ordinary skill in the art including, but not limited to, padding, spraying, roller coating or other types of coating, exhaustion, and combinations thereof, followed by a curing step to ensure the polymer forming process. Among them, padding and exhaustion are preferred.

With regard to padding, a padding bath is prepared comprising sodium pyrithione and a binder and/or softener. Examples of a binder include, but are not limited to, a polyacrylic binder, a polyurethane binder, or a combination thereof. The pH range of the padding bath is preferably in a range of 4 to 8.5. The pH range should be in a desirable range in order to maintain the integrity of the textile, as well as maintain a desirable tactile sensation on the surface of the textile.

Once the padding bath is prepared or obtained, the padding bath is applied to a textile. The padded textile is preferably cured at a curing temperature in a range of 130° C. to 180° C. and for a minimum of 45 seconds.

With regard to exhaustion, sodium pyrithione and binder are added during a pre-dye stage with sodium benzoate and carboxylic acid (citric acid, lactic acid) at a temperature of 60° C. to 85° C. and for 20 min to 1 hour.

The textile can be made of various types of fibers including, but not limited to, synthetic fibers, natural fibers, and a combination thereof.

Textiles can be used in a number of articles including, but not limited to, yarns, filaments, fabrics, clothing, apparel, foot wear, bedding, curtain, uniform, carpet, upholstery, face mask, gown, carpets, upholstery, foams and nonwoven filters.

WORKING EXAMPLES

Example 1—Antimicrobial Performance

The following example demonstrates the durability of the treatment of the invention. The term "durability", as used herein, generally refers to the ability of an antimicrobial property of a treated textile fabric to withstand an extended number of washes or home launderings (HL).

Tests were conducted in accordance with AATCC TM 100 to demonstrate antimicrobial performance. Below Table 1 clearly shows that when sodium pyrithione, a binder or a softener was used separately, they did not have antimicrobial performance after twenty-five launderings, for sodium pyrithione, data after one wash was included, which shows little efficacy even after only one cycle of home laundering, because sodium pyrithione does not have any fastness on textiles due to its water solubility, and a binder or a softener does not have antimicrobial capability. But when sodium pyrithione and binder were used together, it showed synergy and very good antimicrobial performance after twenty-five home launderings, as there was an invisible polymer coating formed. When sodium pyrithione and binder were mixed together with a softener, then applied on the fabric, it showed boosted synergy and an even greater antimicrobial efficacy. Wet crocking fastness of treated article was also improved from 3.5 score to 4.5 score, when testing against the AATCC TM 8. Because the surface roughness and friction was reduced by the softener.

The synergistic effect with the combination of the sodium pyrithione and the binder creates an invisible polymer film on the fabric surface, making the treatment durable. The uniqueness of the chosen binder is such that it is compatible with the ionicity of sodium pyrithione and is able to effectively prevent its rapid dissolution during laundering and over multiple laundering cycles. Further, addition of a softener boosts the quality of the binder film. The softener is able to reduce the surface roughness and friction, further increase the crocking and tactile sensation of treated textile articles.

TABLE 1

| Sample Description | AATCC TM 100, Antimicrobial Test result (Kp - log reduction) |
|---|---|
| 1.5% o.w.f. Sodium Pyrithione on polyester, 1 HL | 0.5 |
| 1.5% o.w.f. Sodium Pyrithione on polyester, 25 HL | 0 |
| 1% o.w.f. polyacrylic binder on polyester, 25 HL | 0.4 |
| 1% o.w.f. polysiloxane softener on polyester, 25 HL | 0 |
| 1.5% o.w.f. Sodium Pyrithione + 1% o.w.f. poly acrylic binder on polyester, 25 HL | 2 |
| *2.2% o.w.f. Sodium Pyrithione + poly acrylic binder + polysiloxane softener on polyester, 25 HL | 3.1 |
| Untreated polyester control | 0 |

*11 weight % Sodium pyrithione, 18 weight % poly acrylic binder, and 17 weight % polysiloxane softener was premixed, then 2.2% o.w.f. premix formula was applied to polyester.

Example 2—Antifungal Performance

Tests were performed with: (a) an untreated control fabric; (b) sodium pyrithione and binder treated fabric, and (c) sodium pyrithione, binder, and a softener treated fabric, respectively. The tests followed AATCC TM 30—III. The higher the score, the worse the antifungal results were.

(a) Untreated control, score=2

(b) Sodium pyrithione and binder, score=1

(c) Sodium pyrithione and binder and softener, score=0

Performance was significantly improved with (b) and was even more significantly improved with (c).

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A liquid antimicrobial composition comprising:

sodium pyrithione at a concentration ranging from 6 weight % to 16 weight % of the overall composition, a binder at a concentration ranging from 10 weight % to 25 weight % of the overall composition, and water, wherein the weight percentages are based on a total weight of the composition.

2. The liquid antimicrobial composition according to claim 1, further comprising a softener at a concentration ranging from 10 weight % to 30 weight % of the overall composition.

3. The liquid antimicrobial composition according to claim 1, wherein the composition is heavy metal-free.

4. The liquid antimicrobial composition according to claim 1, wherein the binder is selected from the group consisting of a polyacrylic binder, a polyurethane binder, and a combination thereof.

5. The liquid antimicrobial composition according to claim 2, wherein the softener is selected from the group consisting of a sulphated fatty alcohol, anionic fatty acid polysiloxane, nonionic fatty acid polysiloxane, ethoxylated polysiloxane, polyethylene based softener, and a combination thereof.

6. A method of treating a textile, the method comprising:

applying the liquid antimicrobial composition of claim 1 to a textile thereby imparting antimicrobial efficacy to the textile.

7. The method of claim 6, wherein the liquid antimicrobial composition is heavy metal-free.

8. The method according to claim 6, wherein the liquid antimicrobial composition further comprises from 10 weight % to 30 weight % of a softener.

9. The method according to claim 6, wherein the textile is a fabric.

10. The method according to claim 6, wherein the binder is selected from the group consisting of a polyacrylic binder, a polyurethane binder, and a combination thereof.

11. The method according to claim 8, wherein the softener is selected from the group consisting of a sulphated fatty alcohol, anionic fatty acid polysiloxane, nonionic fatty acid polysiloxane, ethoxylated polysiloxane, polyethylene based softener, and a combination thereof.

12. The method according to claim 6, wherein the liquid antimicrobial composition is applied by a method selected from the group consisting of padding, spraying, roller coating, exhaustion, and a combination thereof.

13. The method according to claim 12, wherein the liquid antimicrobial composition is applied to the textile by padding in a padding bath.

14. The method according to claim 13, wherein the textile after padding is cured at a curing temperature in a range of 130° C. to 180° C.

15. The method according to claim 13, wherein the textile after padding is cured for a minimum of 45 seconds.

16. The method according to claim 12, wherein the liquid antimicrobial composition is added during a dyeing stage of exhaustion.

17. The method according to claim 12, wherein the liquid antimicrobial composition is added at a temperature in a range of 60° C. to 130° C.

18. The method according to claim 12, wherein the liquid antimicrobial composition is exhausted for twenty minutes to one hour.

19. A article comprising a textile material treated with the liquid antimicrobial composition of claim 1.

20. The article according to claim 19, wherein the liquid antimicrobial composition is heavy metal-free.

21. The article according to claim 19, wherein the binder is selected from the group consisting of polyacrylic binder, a polyurethane binder, and a combination thereof.

22. The article according to claim 19, wherein the liquid antimicrobial composition further comprises from 10 weight percent to 30 weight percent of a softener.

23. The article according to claim 19, wherein water is the balance of the total weight of the liquid antimicrobial composition.

* * * * *